US008278019B2

(12) United States Patent
Yoshida et al.

(10) Patent No.: US 8,278,019 B2
(45) Date of Patent: Oct. 2, 2012

(54) METHOD OF MANUFACTURING ELECTROSTATIC CHARGE IMAGE DEVELOPING TONER

(75) Inventors: Eiichi Yoshida, Tokyo (JP); Kenichi Onaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 468 days.

(21) Appl. No.: 12/709,824

(22) Filed: Feb. 22, 2010

(65) Prior Publication Data

US 2010/0227268 A1 Sep. 9, 2010

(30) Foreign Application Priority Data

Mar. 4, 2009 (JP) ..... 2009-050555

(51) Int. Cl.
*G03G 5/00* (2006.01)
*G03G 9/00* (2006.01)

(52) U.S. Cl. ..... 430/137.1; 430/137.14

(58) Field of Classification Search ..... 430/137.1, 430/137.14

See application file for complete search history.

(56) References Cited

U.S. PATENT DOCUMENTS

2004/0209182 A1* 10/2004 Kawase ..... 430/137.14
2008/0171276 A1* 7/2008 Urabe et al. ..... 430/105

FOREIGN PATENT DOCUMENTS

| | | |
|---|---|---|
| JP | 2000214629 | 8/2000 |
| JP | 2000292976 | 10/2000 |
| JP | 2001249490 | 9/2001 |
| JP | 2006325895 | 12/2006 |
| JP | 2008233175 | 10/2008 |

* cited by examiner

*Primary Examiner* — Thorl Chea
(74) *Attorney, Agent, or Firm* — Lucas & Mercanti, LLP

(57) ABSTRACT

Provided is a method of manufacturing an electrostatic charge image developing toner exhibiting reduced variation in charging amount among manufacturing lots, which is capable of generating no fog, and acquiring high density print images. Disclosed is a method of manufacturing an electrostatic charge image developing toner, possessing the step of washing toner mother particles having been formed in an aqueous medium with washing water, wherein the washing water has a total dissolution component amount of at least 0.05 mg/liter and less than 0.5 mg/liter.

8 Claims, 3 Drawing Sheets

METHOD OF MANUFACTURING ELECTROSTATIC CHARGE IMAGE DEVELOPING TONER

This application claims priority from Japanese Patent Application No. 2009-050555 filed on Mar. 4, 2009, which is incorporated hereinto by reference.

TECHNICAL FIELD

The present invention relates to a method of manufacturing an electrostatic charge image developing toner.

BACKGROUND

In recent years, attention has been focused on a wet-granulated toner in place of another toner prepared via mechanical pulverization, since the wet-granulated toner is advantageous to introduction of a large amount of wax capable of exhibiting a sharp particle distribution, together with a particle in small size thereof. Examples of the method of manufacturing a toner granulated by a wet process include an emulsion association method, a suspension polymerization, a dispersion polymerization, and also a dissolving suspension method employing polyester or the like having been separately subjected to polycondensation.

It is disclosed that a polymerized toner obtained by an emulsion association method to form toner mother particles via a polymerization process in an aqueous medium has a sharp particle size distribution together with small particle size thereof, since shape and particle size of the toner mother particles can be controlled in a preparation process, and rounded toner having no corner on the surface of each of particles having uniform shape of the toner mother particle is obtained (refer to Patent Document 1, for example).

Since the toner having uniform shape and size as described above is expected to result in high-resolution images, introduction to digital system image formation to form fine dot images of 1200 dpi (dpi represents the number of dots per inch or 2.54 cm), for example, is increasingly discussed.

After forming toner mother particles in an aqueous medium or an organic solvent to prepare a toner mother particle dispersion, toner mother particles are separated from the toner mother particle dispersion employing a separation device represented by a solid-liquid separator like a filtration device to obtain toner granulated via a wet process after adding external additives, if desired. A surfactant and impurities such as free wax particles released from toner mother particles or their decomposed material particles are contained in a dispersion in which the toner mother particles are dispersed. Accordingly, when separating the toner mother particles from the dispersion, washing should be well-conducted in such a manner that these impurities do not remain in the toner mother particles.

In order to remove impurities from the toner mother particles, disclosed is a technique by which washing water is supplied until electrical conductivity of a filtrate reaches not more than the specific value, while the toner mother particles are separated from the toner mother particle dispersion via centrifugal separation to wash the toner mother particles (refer to Patent Document 2, for example).

Further disclosed is a technique by which the toner mother particles are filtrated under applied pressure to remove impurities after a cleaning solution is added into toner mother particles from which an aqueous medium is removed in a vessel equipped with stirring blades and a filter (refer to Patent Document 3, for example).

In order to flush a surfactant, a dispersion stabilizer and an inorganic salt remaining on the surface of each of toner mother particles, also disclosed is a method by which the toner mother particles are washed with deionized water (refer to Patent Document 4, for example).

Further, in order to flush the surfactant, the dispersion stabilizer and the inorganic salt remaining on the toner mother particles, disclosed is a method by which the toner mother particles (slurry) are washed with deionized water having an electrical conductivity of 1 μS/cm until electrical conductivity of a filtrate reaches 2 μS/cm (refer to Patent Document 5, for example).

(Patent Document 1) Japanese Patent O.P.I. Publication No. 2000-214629

(Patent Document 2) Japanese Patent O.P.I. Publication No. 2000-292976

(Patent Document 3) Japanese Patent O.P.I. Publication No. 2001-249490

(Patent Document 4) Japanese Patent O.P.I. Publication No. 2008-233175

(Patent Document 5) Japanese Patent O.P.I. Publication No. 2006-325895

SUMMARY

However, toner prepared by washing toner mother particles with the above-described deionized water (for example, deionized water having an electrical conductivity of 1 μS/cm) produced a problem such that the charging amount is varied depending on the manufacturing lot of the toner, and fog is generated and image density is lowered when printing a large number of print sheets at low temperature and low humidity (for example, at 10° C. and 20% RH).

It is an object of the present invention to provide a method of manufacturing an electrostatic charge image developing toner exhibiting reduced variation in charging amount among manufacturing lots, which is capable of generating no fog, and acquiring high density print images.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
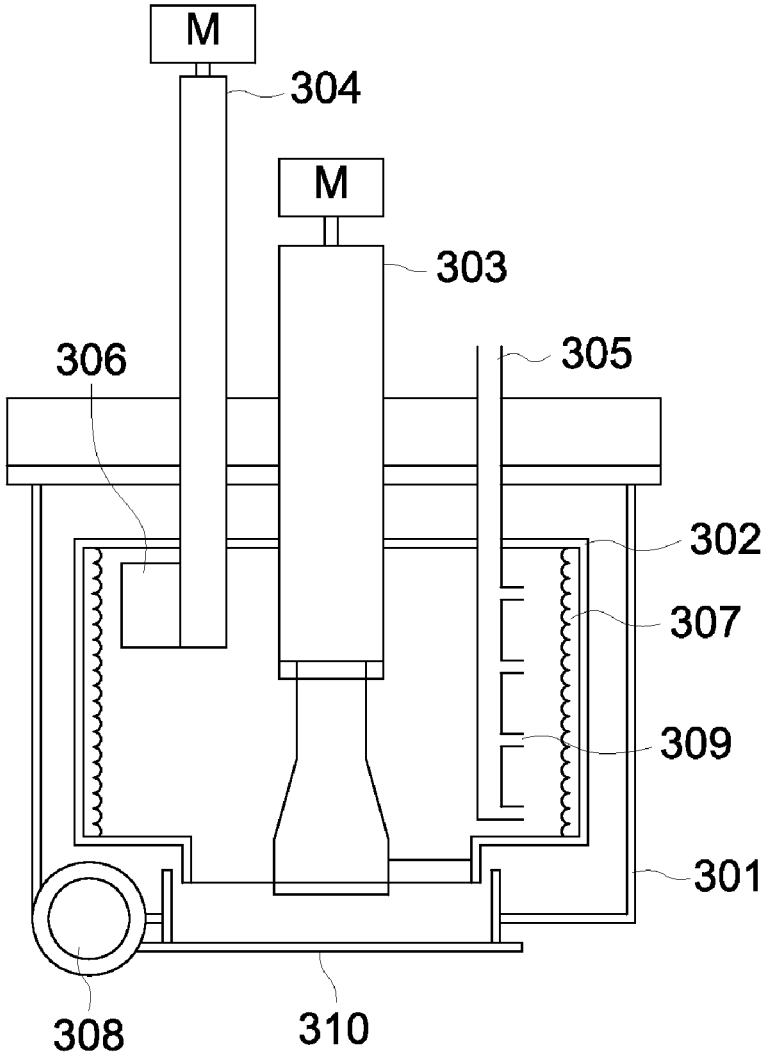
FIG. 1 is a cross-sectional view showing an example of a rotatable cylinder type washing apparatus.

The above object of the present invention is accomplished by the following structures.

(Structure 1) A method of manufacturing an electrostatic charge image developing toner, comprising the step of washing toner mother particles having been formed in an aqueous medium with washing water, wherein the washing water has a total dissolution component amount of at least 0.05 mg/liter and less than 0.5 mg/liter.

(Structure 2) The method of Structure 1, comprising the step of coagulating/fusing resin particles and colorant particles in the aqueous medium to obtain the toner mother particles.

(Structure 3) The method of Structure 2, comprising the steps of forming a toner mother particle dispersion via the step of coagulating/fusing the resin particles and the colorant particles in the aqueous medium, solid-liquid-separating the toner mother particles after cooling the toner mother particle dispersion, washing the toner mother particles having been solid-liquid-separated with the washing water, and drying the toner mother particles having been washed.

(Structure 4) The method of Structure 1, wherein the washing water has a temperature of 25-45° C.

(Structure 5) The method of Structure 1, wherein the total dissolution component in the washing water comprises at least one of a salt obtained via combination of a cation and an anion, a nonionic compound and an organic compound, provided that the cation is one selected from the group consisting of $Ca^{2+}$, $Mg^{2+}$, $Na^{2+}$, $Fe^{2+}$ and $Mn^{2+}$, the anion is one selected from the group consisting of $HCO_3^-$, $Cl^-$, $SO_4^{2-}$ and $NO_3^-$, the nonionic compound is polyoxyethylenealkyl ether, and the organic compound is one compound selected from the group consisting of saccharides and water-soluble vitamins.

(Structure 6) The method of Structure 1, wherein the total dissolution component in the washing water comprises sodium chloride, glucose, sodium dodecyl sulfate or an ascorbic acid.

(Structure 7) The method of Structure 1, wherein weight of the washing water is 1-70 times weight of the toner mother particles.

(Structure 8) The method of Structure 7, wherein the weight of the washing water is 5-30 times the weight of the toner mother particles.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Since in the case of toner mother particles formed in an aqueous medium, a surfactant, a dispersion stabilizer, an inorganic salt and so forth are used in a process of preparing the toner mother particles, these surfactant, dispersion stabilizer, inorganic salt and so forth remain in the toner mother particles. When preparing an electrostatic charge image developing toner (hereinafter, also referred to simply as toner) employing toner mother particles in which surfactant, dispersion stabilizer, inorganic salt and so forth remain, there appears a problem such that fog is generated, and image density is reduced during printing via influence of the surfactant, dispersion stabilizer, inorganic salt and so forth.

In this case, the surfactant, dispersion stabilizer, inorganic salt and so forth remaining on the toner mother particles are desired to be washed away.

In commonly known techniques, deionized water or pure water is employed to wash away the surfactant, dispersion stabilizer, inorganic salt and so forth remaining on the toner mother particles.

However, a toner obtained by washing toner mother particles having a reduced total dissolution component amount in washing water produced a problem such that fog was generated; no high density printing image was obtained; and a charging amount thereof was varied among a large number of manufacturing lots when printing a large number of print sheets at low temperature and low humidity (for example, at 10° C. and 20% RH).

It is expected that the total dissolution components dissolved in washing water affect the above-described problem, and studies concerning this problem have been done by the inventors.

After considerable effort during intensive studies, the inventors have found out that printing images exhibiting high density and no fog can be obtained, and toner exhibiting reduced variation in charging amount among toner manufacturing lots can be prepared by employing washing water containing a specific total dissolution component amount for washing toner mother particles formed in an aqueous medium, even though printing a large number of print sheets at low temperature and low humidity (for example, at 10° C. and 20% RH).

When the total dissolution component amount in washing water is a very small amount of less than 0.05 mg/liter, it is assumed that toner is excessively charged since the number of portions to release charge onto the toner particle surface is reduced. The excessive charging becomes large specifically at low temperature and low humidity, whereby presumably, image fog is generated, and image density is lowered.

On the other hand, when the total dissolution component amount in washing water exceeds the range of the present invention such as 0.05 mg/liter or more, a water-soluble component remains on the toner surface, and specifically, the charging amount of a part of the toner is reduced at high temperature and high humidity, whereby transfer image unevenness is generated in halftone images.

As to methods to control washing water having been disclosed with electrical conductivity, since electrical conductivity is affected by dissolved gas (mainly, carbon dioxide), it is difficult to control washing water with electrical conductivity, and the charging amount of toner among toner manufacturing lots is varied, resulting in possible generation of a problem.

It is assumed that when toner mother particles are washed with washing water containing a total dissolution component amount of at least 0.05 mg/liter and less than 0.50 mg/liter, or preferably washing water containing a total dissolution component amount of at least 0.05 mg/liter and less than 0.25 mg/liter, a surfactant, a dispersion stabilizer, an inorganic salt and so forth remaining on the toner mother particles tend to be easily substituted by the dissolution components, whereby the surfactant, the dispersion stabilizer, the inorganic salt and so forth remaining on the toner mother particles are easily removed.

It is also assumed that the surfactant, the dispersion stabilizer, the inorganic salt and so forth remaining on the toner mother particles are removed, and at the same time, the dissolution components contained in washing water are attached thereto, whereby the portions to release charge onto the toner particle surface are newly formed.

Since washing water of the present invention contains a total dissolution component amount of at least 0.05 mg/liter and less than 0.50 mg/liter, the number of portions to release charge onto the toner particle surface becomes constant. As the result, printing images exhibiting high density and no fog can be obtained, and toner exhibiting reduced variation in charging amount among toner manufacturing lots can be prepared, even though printing a large number of print sheets at low temperature and low humidity (for example, at 10° C. and 20% RH).

On the other hand, in the case of the washing water having a total dissolution component amount of 0.50 mg/liter or more, and exceeding the range of the present invention, a water-soluble component remains on the toner surface, and a charging amount of a part of the toner is reduced specifically at high temperature and high humidity, whereby transfer image unevenness of halftone images is generated.

Next, the present invention will now be described in detail.

First, the total dissolution component amount of the present invention will be described.

<<Total Dissolution Component Amount>>

The total dissolution component amount of the present invention means weight of the dissolution components dissolved in a washing water of 1 liter at 25° C.

In the present invention, the total dissolution component amount (weight of dissolution components) is a value determined by a method of drying by heating.

The measurement method by conducting a drying-by-heating process is a method by which a washing water of 2.0 ml obtained by removing an undissolved quantity via filtration with a filter having a mesh of 0.1 μm is taken with an accuracy of ±10%, and heated at 60° C. for 30 minutes, at 70° C. for 30 minutes, at 80° C. for 30 minutes, at 90° C. for 30 minutes, at 100° C. for 30 minutes and at 105° C. for 30 minutes, in the step mode employing an electronic moisture balance MOC-120, manufactured by Shimadzu Corporation to determine a remaining solid content thereof.

The dissolution component is an inorganic or organic compound, and examples thereof include salts obtained via combination of the following ions, nonionic compounds and so forth.

Cation ($Ca^{2+}$, $Mg^{2+}$, $Na^{2+}$, $Fe^{2+}$ and $Mn^{2+}$)

Anion ($HCO_3^-$, $Cl^-$, $SO_4^{2-}$ and $NO_3^-$)

{For example, sodium chloride and calcium hydrogen carbonate $Ca(HCO_3)_2$}

Nonionic compound (polyoxyethylenealkyl ether and so forth)

Others (organic compounds such as saccharides and water-soluble vitamins)

Preferred examples of the total dissolution component in the washing water include sodium chloride, glucose, sodium dodecyl sulfate and an ascorbic acid.

Next, a method of preparing washing water will be described.

<<Method of Preparing Washing Water>>

The method of preparing washing water is not specifically limited, as long as the washing water containing a total dissolution component amount of not less than 0.05 mg/liter and less than 0.50 mg/liter at 25° C. can be obtained. As a preferred preparation method, provided can be a method of preparation by dissolving the dissolution component such as a cation, an anion, a nonionic compound or the like in 25° C. deionized water obtained by removing an undissolved quantity via filtration with a filter, in such a manner that the total dissolution component amount falls within the range of not less than 0.05 mg/liter and less than 0.50 mg/liter.

Next, a method of preparing a toner of the present invention will be described.

<<Method of Preparing Toner>>

The method of preparing a toner of the present invention is a method to prepare the toner via a step of forming toner mother particles in an aqueous medium, and a step of washing the toner mother particles with washing water containing a specific total dissolution component amount.

As the preferred preparation method, provided can be a method to prepare the toner via a step of preparing a dispersion of toner mother particles in an aqueous medium; a step of solid-liquid-separating toner mother particles from the dispersion of toner mother particles; a step of washing the toner mother particles with washing water containing a specific amount of dissolution components in order to newly attach a given dissolution component amount, after removing impurities (a surfactant, a dispersion stabilizer and an inorganic salt, for example) remaining on the surface of each of the toner mother particles obtained via solid-liquid separation; a step of preparing the toner mother particles dried after washing; and a step of mixing and adding external additives into the dried toner mother particles.

The aqueous medium of the present invention means a medium containing 50-100% by weight of water and 0-50% by weight of a water-soluble organic solvent, and preferably a medium containing 90-100% by weight of water and 0-10% by weight of a water-soluble organic solvent. As the water-soluble organic solvent, methanol, ethanol, isopropanol, butanol, acetone, methyl ethyl ketone and tetrahydrofuran can be exemplified, and an alcoholic organic solvent which does not dissolve a resin to form toner mother particles is preferable.

Next, a washing method and a washing step thereof to wash toner mother particles will be described.

The method of washing toner mother particles is not specifically limited, and examples thereof include a centrifugal separation method, a filtration method under reduced pressure employing a Nutsche funnel, and a filtration method employing a filter press or the like.

As a preferred method of washing toner mother particles, provided can be a rotatable cylinder type washing apparatus by a centrifugal separation method.

FIG. 1 is a cross-sectional view showing an example of a rotatable cylinder type washing apparatus.

In FIG. 1, numeral 301 represents a main body; numeral 302 represents a basket (rotatable cylinder); numeral 303 represents a basket rotation device; numeral 304 represents a scraping device; numeral 305 a liquid-supply pipe; numeral 308 represents a liquid-outlet; numeral 310 represents a cake-outlet; numeral 306 represents a scraper; numeral 309 represents a liquid spray nozzle; and numeral 307 represents a filter.

The rotatable cylinder type washing apparatus shown in FIG. 1 is an apparatus type to discharge a toner cake from the lower portion, and basket 302 (rotatable cylinder), basket rotation device 303, scraping device 304, liquid-supply pipe 305, liquid-outlet 308 and cake-outlet 310 are installed in main body 301. Scraping device 304 is equipped with scraper 306, liquid-supply pipe 305 is equipped with liquid spray nozzle 309, and basket 302 (rotatable cylinder) is equipped with removable filter 307. A toner mother particle dispersion is supplied from liquid-supply pipe 305 at a starting point, and solid and liquid are separated by rotating basket 302 at high speed to form the toner cake on the surface of filter 307. A filtrate is discharged from liquid-outlet 308.

Specific washing water is subsequently sprayed from spray nozzle 309 of liquid-supply pipe 305 to wash the toner cake. The washing water of the toner cake is discharged from liquid-outlet 308.

After this, the washed toner cake is dehydrated by rotating basket 302 at high speed, scraped by scraper 306 while rotating basket 302 at low speed, and discharged from cake-outlet 310.

The weight of the washing water sprayed from spray nozzle 309 is preferably 1-70 times weight of toner mother particles, and more preferably 5-30 times the weight of the toner mother particles.

It is preferred that a residual amount of impurities remaining on toner mother particles is reduced by draining the specific washing water having at least 5 times the weight of toner mother particles. It is also preferred that not only the washing time can be shortened, but also the production cost can be reduced by draining the specific washing water having not more than 30 times the weight of toner mother particles.

The basket (rotatable cylinder) during washing preferably has an acceleration of 500-1000 G, and more preferably has an acceleration of 600-800 G. When falling within this acceleration range, it is preferred that washing water can be supplied evenly to the entire toner cake, and impurities remaining on the toner mother particles can be well removed.

A supply amount of washing water to be employed for washing is preferably in the amount range where no washing water is retained in the rotatable cylinder type washing apparatus. It is preferred that there appeared no problem such that impurities once separated from toner mother particles are reattached onto the toner mother particles, if there is no retention of washing water.

Figure 2:
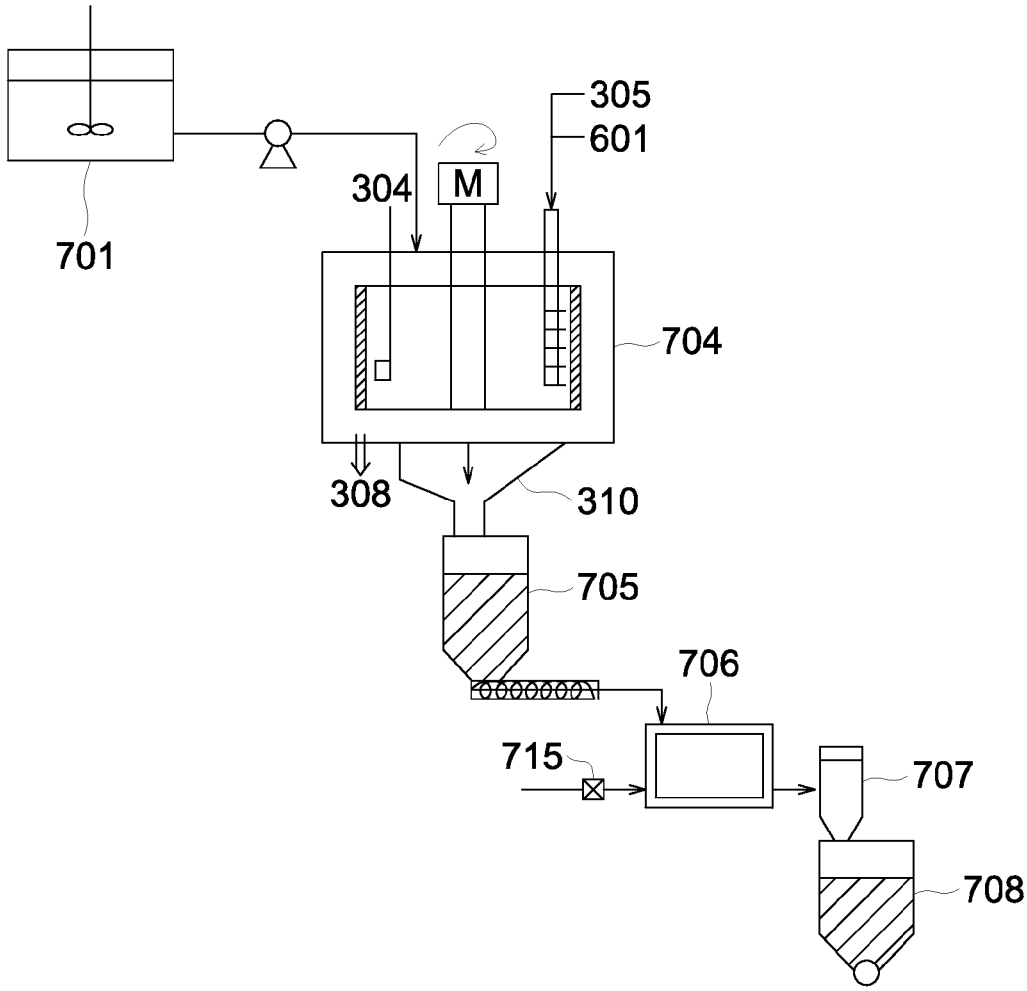
FIG. 2 is a manufacturing flow illustration (manufacturing process diagram) showing an example of washing steps to wash toner mother particles.

FIG. 2 is a manufacturing flow illustration (manufacturing process diagram) showing an example of washing steps to wash toner mother particles.

In FIG. 2, numeral 701 represents a tank; numeral 701 represents a rotatable cylinder type washing apparatus; numeral 308 represents an outlet; numeral 306 represents a scraping device; numeral 310 represents a cake-outlet; numeral 705 represents a stock tank; numeral 706 represents a drying device; numeral 715 represents hot air; numeral 707 represents a cyclone; and numeral 708 represents a toner mother particle stock tank.

The flow shown in FIG. 2 will be described. A toner mother particle dispersion stocked in tank 701 is charged into rotatable cylinder type washing apparatus 704, and rotatable cylinder type washing apparatus 704 is continuously operated while balancing a supply amount of the toner mother particle dispersion and a liquid amount discharged from outlet 308. The operation is stopped when completing a given amount of solid-liquid separation to conduct washing with washing water containing the specific total dissolution component amount. Dehydrating is carried out after completing the washing. The toner cake is taken out from cake-outlet 310 by scraping device 304. The toner cake taken out is stored in stock tank 705 and transported into drying device 706 after preferably conducting a pulverizing process, followed by drying with hot air 715, and toner mother particles are subsequently collected with cyclone 707 to store them in stock tank 708.

Next, an emulsion association method is provided as an example, and a method of manufacturing a toner thereof will be described in detail.

The toner prepared by the emulsion association method is manufactured via the following steps.

(1) A step of preparing a dispersion in which wax is dissolved or dispersed in a radically polymerizable monomer.

(2) A step of preparing core resin particles via polymerization of the radically polymerizable monomer in the dispersion.

(3) A step of forming toner mother particles via coagulation/fusion of the core resin particles with colorant particles in an aqueous medium.

(4) A step of washing a surfactant or the like from the toner mother particles with washing water containing a specific amount of the dissolution components by solid-liquid-separating the toner mother particles after cooling the toner mother particle dispersion.

(5) A step of drying the washed toner mother particles.

Further, if desired, after the step of drying the washed toner mother particles, conducted may be (6) A step of preparing a toner via addition of external additives into the toner mother particles having been subjected to the foregoing drying step.

Next, each of the steps will be described.

(1) Step of Preparing Dispersion

This step is a step by which wax is dispersed or dissolved in a radically polymerizable monomer to prepare a radically polymerizable monomer dispersion in which wax is mixed.

(2) Step of Preparing Core Resin Particle

In a preferred example of this step, a radically polymerizable monomer solution containing a dissolved or dispersed wax is added into an aqueous medium containing a surfactant having not more than critical micelle concentration (CMC), followed by formation of liquid droplets via application of mechanical energy, and a water-soluble radical polymerization initiators is subsequently added to perform polymerization reaction in the liquid droplets. In addition, an oil-soluble polymerization initiator may be contained in the foregoing droplets. In such a polymerization process, a compulsorily emulsifying treatment (formation of liquid droplets) is to be carried out via application of mechanical energy. In this case, examples of devices to apply mechanical energy include strong stirring devices or devices capable of applying ultrasonic vibration energy such as a homomixer, ultrasonic waves, a Manton-Gaulin homogenizer and so forth.

In addition, core polymer particles are prepared as core resin particles, and particles each possessing multilayered resin layers formed on the core polymer particle surface via multi-stage polymerization may be prepared.

The core resin particles preferably have a number average primary particle diameter of 10-1000 nm, and more preferably have a number average primary particle diameter of 30-300 nm.

This number average primary particle diameter is a value measured by an electrophoretic light scattering photometer "ELS-800" (manufactured by Otsuka Electronics Co., Ltd.).

The core resin particles each containing wax can be obtained via this step.

(3) Step of Preparing Toner Mother Particle

In this step, toner mother particles are prepared via coagulation/fusion of core resin particles with colorant particles. A salting-out/fusing method is preferred as a method of coagulating/fusing core resin particles. Further, in the coagulation/fusion process, internal additive particles such as wax particles and charge control agents with the core resin particles and the colorant particles can be coagulated and fused.

In addition, "salting-out/fusing" described herein means that when salting-out and fusing both take place in parallel and particles each grow up to the desired particle diameter, the particle growth is terminated by adding an a coagulation-terminating agent, and further, heating is continuously conducted to control the particle shape, if desired.

The colorant particles can be prepared by dispersing a colorant in an aqueous medium. The dispersion treatment of the colorant is conducted in a state where concentration of a surfactant in water is set to not less than critical micelle concentration (CMC). Homogenizers employed for conducting the dispersion treatment for the colorant are not specifically limited, but preferred examples thereof include an ultrasonic homogenizer, a mechanical homogenizer, a pressing dispersion apparatus such as a Manton-Gaulin homogenizer or a pressure type homogenizer, a sand grinder, a medium type dispersion apparatus such as a Getzmann mill or a diamond fine mill. Further, as utilized surfactants, provided can be those identical to the foregoing surfactants. In addition, the colorant may be surface-modified. The method of surface-modifying the colorant is conducted as follows. The colorant is dispersed in a solvent, and a surface modifier is added into the dispersion to conduct reaction by raising temperature of this system. After completing the reaction, the colorant is filtered, and filtration by washing is repeated with the same solvent, followed by drying to obtain a colorant having been treated with the surface modifier (pigment).

A salting-out/fusing method as a preferred coagulating/fusing method is a process in which a salting-out agent composed of an alkali metal salt, an alkaline earth metal salt and a trivalent salt is added into water containing core resin particles and colorant particles as a coagulant having not less than the critical coagulation concentration, and then, salting-out and fusing are conducted at the same time by heating to at least the glass transition point of the foregoing core resin particles, and to the melting peak temperature (° C.) of the foregoing mixture. Herein, examples of the alkali metal salt and the alkaline earth metal salt as a salting-out agent include alkali metal salts such as lithium, potassium and sodium, and alkaline earth metal salts such as magnesium, calcium, strontium and barium. Of these, potassium, sodium, magnesium, calcium and barium are preferable.

The range of this addition temperature is preferably not more than a glass transition point of the resin, but it is generally 5-55° C., and preferably 10-45° C.

(4) Cooling•Solid-Liquid Separation•Washing Step

This cooling step is a step to conduct a cooling treatment for a dispersion of the foregoing toner mother particles. In the cooling treatment condition, cooling is conducted at a cooling rate of 1-20° C./min. A method of conducting the cooling treatment is not specifically limited, but examples thereof include a method of cooling the exterior of a reaction vessel by flowing a cooling medium into a cooling pipe, and a method of directly charging chilled water in a reaction system for cooling.

In the solid-liquid separation•washing step, the following treatments are applied: a solid-liquid separation treatment to separate the toner mother particles from a toner mother particle dispersion cooled down to a predetermined temperature in the above-described step, and a washing treatment to wash a residue such as a surfactant or a salting-out agent from the solid-liquid-separated toner cake (an aggregate obtained by coagulating the toner mother particles in a wet state so as to produce a cake form) with washing water containing a specific amount of dissolution components, and to newly attach a given amount of the dissolution components.

(5) Drying Step

The drying process is a step in which the washed toner cake is subjected to a drying treatment to obtain dried toner mother particles. Preferred examples of driers employed in this step include a spray drier, a vacuum freeze drier, a decompression dryer, a stationary rack dryer, a movable rack dryer, a fluid layer drier, a rotary type drier, a stirring type drier and others. Moisture in the toner mother particle is preferably not more than 3.0% by weight, but is more preferably not more than 1.5% by weight. In addition, when the toner mother particle-to-toner mother particle having been subjected to a drying treatment is coagulated via weak inter-particle attractive force, the aggregate may be pulverized. Herein, examples of pulverizing apparatuses include mechanical pulverizing apparatuses such as a jet mill, a HENSCHEL mixer, a coffee mill and a food processor.

Step of Preparing Toner

This step is a step in which a toner is prepared by mixing external additives in the dried toner mother particles.

Mechanical mixers such as a HENSCHEL mixer or a coffee mill may be employed as a mixer for external additives.

Next, members employed for preparing toner of the present invention will be described.

<Member Employed for Preparing Toner>

(Binder Resin)

The resin to form core resin particles is preferably a styrene-acryl based copolymer resin. Further, a monomer employed to prepare the core resin particles is preferably copolymerized with a polymerizable monomer with which a glass transition point (Tg) of the resulting copolymer is lowered, such as propyl acrylate, propyl methacrylate, butyl acrylate or 2-ethylhexyl acrylate. Further, a monomer to prepare a shell resin employed to form a shell layer is preferably copolymerized with a polymerizable monomer with which a glass transition point (Tg) of the resulting copolymer is raised, such as styrene, methyl methacrylate or a methacrylic acid.

Resins each constituting the toner are further detailed.

As the core resin and the shell resin, polymers obtained by polymerizing the following polymerizable monomers are usable.

The resins employed in the present invention include a polymer obtained by polymerizing at least one polymerizable monomer as a constituent component, but examples of the foregoing polymerizable monomer include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene or p-n-dodecylstyrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate or dimethylaminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate or phenyl acrylate; olefins such as ethylene, propylene, or isobutylene; halogen based vinyls such as vinyl chloride, vinylidene chloride, vinyl bromide, vinyl fluoride or vinylidene fluoride; vinyl esters such as vinyl propionate, vinyl acetate, or vinyl benzoate; vinyl ethers such as vinyl methyl ether or vinyl ethyl ether; vinyl ketones such as vinyl methyl ketone, vinyl ethyl ketone or vinyl hexyl ketone; vinyl compounds such as N-vinylcarbazole, N-vinylindole or N-vinylpyrrolidone; vinyl compounds such as vinylnaphthalene or vinylpyridine; and acrylic or methacrylic acid derivatives such as acrylonitrile, methacrylonitrile or acrylamide. These vinyl based monomers may be employed individually or in combination.

Further, as a polymerizable monomer constituting the resin, it is also preferable to employ those having an ionic dissociating group in combination. Examples thereof include those having a substituent such as a carboxyl group, a sulfonic acid group or a phosphoric acid group as a constituent group of the monomer. Preferred examples include an acrylic acid, a methacrylic acid, a maleic acid, an itaconic acid, a cinnamic acid, a fumaric acid, monoalkyl maleate, monoalkyl itaconate, styrene sulfonic acid, allylsulfosuccinic acid, 2-acrylamido-2-methylpropanesulfonic acid, acid phosphoxyethyl methacrylate and 3-choro-2-acid phosphoxypropyl methacrylate.

Further, it is also possible to produce resins having a crosslinking structure employing polyfunctional vinyls such as divinylbenzene, ethylene glycol methacrylate, ethylene glycol diacrylate, diethylene glycol dimethacrylate, diethylene glycol diacrylate, triethylene glycol dimethacrylate, triethylene glycol diacrylate, neopentyl glycol dimethacrylate or neopentyl glycol diacrylate.

(Colorant)

Any of carbon blacks, dyes and pigments can be used as a colorant of the present invention, and examples of the carbon blacks include channel black, furnace black, acetylene black, thermal black and lamp black.

Usable examples of the dye include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93 and C.I. Solvent Blue 95, and further, mixtures thereof are also usable. Usable examples of the pigment include C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Orange 31, C.I. Pigment Orange 43, C.I. Pigment Yellow 14, C.I. Pigment Yellow 17, C.I. Pigment Yellow 93, C.I. Pigment Yellow 94, C.I. Pigment Yellow 138, C.I. Pigment Yellow 156, C.I. Pigment Yellow 158, C.I. Pigment Yellow 180, C.I. Pigment Yellow 185, C.I. Pigment Green 7, C.I. Pigment Blue 15:3 and C.I. Pigment Blue 60, and further mixtures thereof are also usable. The number average primary particle diameter varies depending on the type, but generally, the number average primary particle diameter is preferably 10-200 nm.

(Wax)

As waxes usable in the present invention provided can be commonly known waxes. Preferred examples thereof include polyolefin wax such as polyethylene wax or polypropylene wax; long chain hydrocarbon based wax such as paraffin wax or sasol wax; dialkyl ketone based wax such as distearyl ketone; ester based wax such as carnauba wax, montan wax, trimethylolpropane tribehenate, pentaerythritol tetramyristate, pentaerythritol tetrastearate, pentaerythritol tetabehenate, pentaerythritol diacetate dibehenate, glycerin tribehenate, 1,18-octadecanediol distearate, tristearyl trimelliate or distearyl maleate; and amide based wax such as ethylenediaminebehenylamide or trimellitic acid tristearylamide.

The wax preferably has a melting point of 40-160° C., more preferably has a melting point of 50-120° C., and still more preferably has a melting point of 60-90° C. By allowing the melting point to be within the above-described range, not only a heat resistance storing property of toner is acquired, but also stable toner image formation is conducted without generating cold offsetting even during low temperature fixing. Further, the wax in the toner preferably has a content of 1-30% by weight, and more preferably has a content of 5-20% by weight.

Polymerization initiators, chain transfer agents and surfactants usable in a manufacturing method of the above-described toner will be described.

(Radical Polymerization Initiator)

The resin constituting core resin particles is prepared by polymerizing the foregoing polymerizable monomers, but radical polymerization initiators usable in the present invention are those described below. Preferred examples of oil-soluble polymerization initiators include azo or diazo based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; peroxide based polymerization initiators such as benzoyl peroxide, methyl ethyl ketone peroxide, diisopropyl peroxycarbonate, cumene hydroperoxide, t-butylhydroperoxide, di-t-butyl peroxide, dicumyl peroxide, 2,4-dichlorobenzoyl peroxide, lauroyl peroxide, 2,2-bis-(4,4-t-butylpeoxycyclohexyl)propane and tris-(t-butylperoxy)triazine; and polymer initiators having a peroxide in the side chain.

Further, when the resin is formed by an emulsion polymerization method, water-soluble radical polymerization initiators are usable. Examples of water-soluble polymerization initiators include persulfates such as potassium persulfate and ammonium persulfate, as well as azobisaminodipropane acetate, an azobiscyanovaleric acid or a salt thereof, and hydrogen peroxide.

In order to control molecular weight of the resin, a chain transfer agent, which is commonly utilized, is usable.

The chain transfer agent is not specifically limited, and usable examples thereof include mercaptans such as octyl mercaptan, dodecyl mercaptan and tert-dodecyl mercaptan; n-octyl-3-mercaptopropionate; terpinolene; carbon tetrabromide; and α-methylstyrene dimer.

(Dispersion Stabilizer)

Further, in order to keep a polymerizable monomer dispersed appropriately in a reaction system, a dispersion stabilizer is also usable. Examples of the dispersion stabilizer include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Further, those commonly used as surfactants, such as polyvinyl alcohol, gelatin, methyl cellulose, sodium dodecylbenzenesulfonate, an ethylene oxide adduct and higher fatty alcohol sodium sulfate can be used as a dispersion stabilizer.

Surfactants employed in the present invention will be described.

In order to conduct polymerization by using the foregoing radically polymerizable monomer, oil droplet dispersion should be carried out in an aqueous medium employing a surfactant. The surfactant usable in this case is not specifically limited, but preferred examples include the following ionic surfactants.

Examples of ionic surfactants include sulfonates (for example, sodium dodecylbenzenesulfonate, sodium aryl alkyl polyethersulfonate, sodium 3,3-disulfondiphenylurea-4,4-diazo-bis-amino-8-naphthol-6-sulfonate, sodium orthocaboxybenzene-azo-dimethylaniline-2,2,5,5-tetramethyltriphenylmethane-4 and 4-diazo-bis-β-naphthol-6-sulfonate); sulfates (for example, sodium dodecylsulfate; sodium tetradodecylsulfate, sodium pentadodecylsulfate and sodium octylsulfate); and fatty acid salts (for example, sodium oleate, sodium laureate, sodium caprate, sodium caprylate, sodium caproate, potassium stearate and potassium oleate).

Further, nonionic surfactants are also usable. Preferred examples thereof include polyethylene oxide, polypropylene oxide, a combination of polypropylene oxide and polyethylene oxide, an ester of polyethylene glycol and a higher fatty acid, alkylphenol polyethylene oxide, ester of a higher fatty acid and polyethylene glycol, ester of a higher fatty acid and polypropylene oxide, polyoxyethylene alkylether, and sorbitan ester.

(External Additive)

The toner used in the present invention is preferably prepared by adding particles such as inorganic or organic particles having a number average primary particle diameter of 4-800 nm as the external additive into toner mother particles.

Addition of the external additive improves fluidity or electrification of toner, and achieves enhanced cleaning ability. The kinds of external additives are not specifically limited, and examples thereof include inorganic or organic particles and a lubricant as described below.

As inorganic particles, those commonly known are usable. Preferred examples thereof include silica particles, titania particles, alumina particles and strontium titanate particles. As the inorganic particles, those having been subjected to a hydrophobilization treatment may be used. Specific examples of silica particles include R-805, R-976, R-974, R-972, R-812 and R-809 which are commercially available from Nippon Aerosil Co., Ltd.; HVK-2150 and H-200 which are commercially available from Hoechst Co.; and TS-720, TS-530, TS-610, H-5 and MS-5 which are commercially available from Cabot Co.

Examples of titania particles include T-805 and T-604 which are commercially available from Nippon Aerosil Co. Ltd.; MT-100S, MT-100B, MT-500BS, MT-600, MT-600SS, JA-1 which are commercially available from Teika Co.; TA-300SI, TA-500, TAF-130, TAF-510 and TAF-510T which are commercially available from Fuji Titan Co., Ltd.; and IT-S, IT-OA, IT-OB and IT-OC which are commercially available from Idemitsu Kosan Co., Ltd.

Examples of alumina particles include RFY-C and C-604 which are commercially available from Nippon Aerosil Co., Ltd.; and TTO-55, which is commercially available from Ishihara Sangyo Co., Ltd.

Spherical organic particles having a number-average primary particle diameter of 10-2000 nm are usable as the organic particles. There is preferably usable a homopolymer such as styrene or methyl methacrylate, or a copolymer of these.

Lubricants such as metal salt of a higher fatty acid is also usable in order to achieve enhanced cleaning ability or transferability. That is, examples thereof include a zinc, copper, magnesium or calcium salt of stearic acid; a zinc, manganese, iron, copper or magnesium salt of oleic acid; a zinc, copper, magnesium or calcium salt of palmitic acid; a zinc or calcium salt of linolic acid; and a zinc or calcium salt of ricinolic acid.

Such an external additive or lubricant in the toner preferably has a content of 0.1-10.0% by weight. Addition of the external additive or lubricant can be conducted employing commonly known various mixing devices such as a turbuler mixer, a Henschel mixer, a Nauter mixer and a V-shape mixer.

<<Developer>>

The toner prepared by a method of manufacturing a toner of the present invention is usable as a nonmagnetic single-component developer or as a two-component developer.

As a mixed ratio of toner to carrier, 3-10% by weight with respect to 100% by weight of carrier are preferable. A method of mixing toner with carrier is not specifically limited, and mixing is possible to be carried out employing a commonly known mixing device.

As the carrier used for a two-component developer, a coating carrier in which magnetic particles are coated by a resin, or a resin dispersion type carrier in which magnetic particles are dispersed in a resin is preferable. The coating resin composition is not specifically limited, but usable examples thereof include olefin based resin, styrene based resin, styrene-acryl based resin, silicone based resin, ester resin and fluorine-containing polymer resin. Resins used for the resin dispersion type carrier are not specifically limited, and those commonly known are usable, such as a styrene-acryl based resin, a polyester resin, a fluororesin and a phenol resin.

Commonly known materials typified by iron, ferrite and magnetite are usable for magnetic particles, but specifically preferable are ferrite particles or magnetite particles.

The volume-based median diameter ($D_{50}$) of the above-described carrier is preferably 15-100 μm, and more preferably 20-80 μm.

The volume-based median diameter ($D_{50}$) of the carrier can be measured employing a laser diffraction type particle size distribution measurement apparatus (HELOS, produced by SYMPATEC Corp.).

The carrier preferably has an initial resistance of $1\times10^{8}$-$3\times10^{10}$ Ωcm, and more preferably has an initial resistance of $2\times10^{8}$-$1\times10^{10}$ Ωcm.

Next, an image forming apparatus will be described.

<<Image Forming Apparatus>>

An image forming apparatus of the present invention can be utilized as a monochromatic image forming apparatus or a color image forming apparatus.

Next, the color image forming apparatus will be described.

The image forming apparatus of the present invention is equipped with at least a charging device to charge a photoreceptor surface; an exposure device to form an electrostatic latent image by exposing the charged photoreceptor to light; a developing device to form a toner image by developing the electrostatic latent image on the photoreceptor with a toner; a primary transfer device to transfer the toner image on the photoreceptor onto an intermediate transfer member; and a transfer device to transfer the toner image transferred onto the intermediate transfer member to a transfer material.

In addition to the above-described devices, the image forming apparatus may further possess a cleaning device to clean the intermediate transfer member and a coating device to coat a fatty acid metal salt on the photoreceptor surface.

Figure 3:
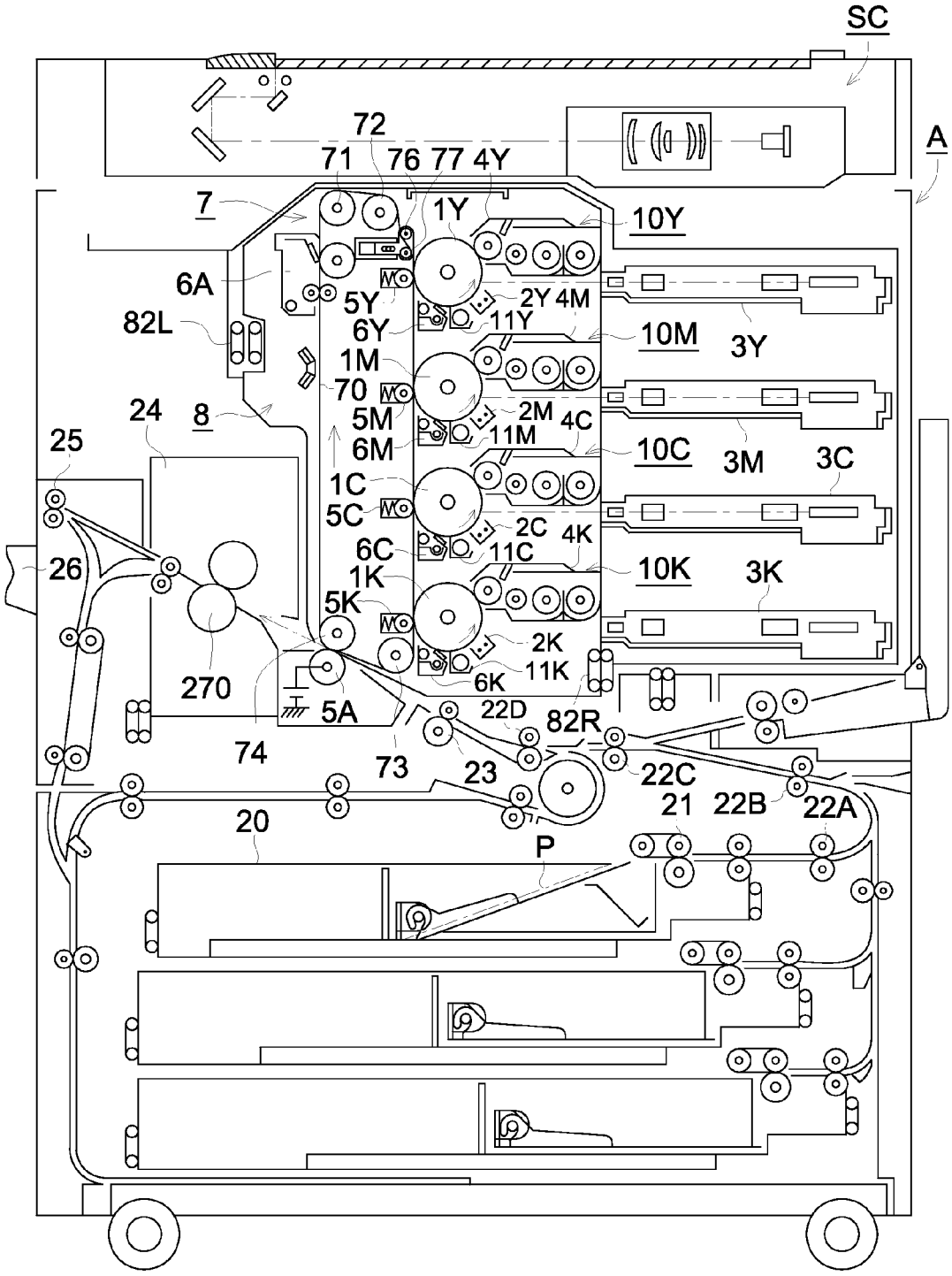
FIG. 3 is a schematic cross-sectional diagram showing an example of a color image forming apparatus.

FIG. 3 is a cross-sectional diagram showing an example of a color image forming apparatus.

This color image forming apparatus called a tandem type color image forming apparatus comprises a plurality of image forming units 10Y, 10M, 10C and 10K, endless-belt-shaped intermediate transfer member unit 7, endless-belt-shaped sheet conveyance device 21 to convey recording medium P, and belt system fixing device 24 as fixing device 24. Document image reading device SC is placed on main body A of the color image forming apparatus.

Image forming unit 10Y forming the yellow image as one toner image out of different colors formed on each photoreceptor comprises drum-shaped photoreceptor 1Y as the first image carrier, charging device 2Y placed around the photoreceptor 1Y, exposure device 3Y, developing device 4Y, primary transfer roller 5Y as a primary transfer device, and cleaning device 6Y. Image forming unit 10M forming the magenta image as one toner image of another different color comprises drum-shaped photoreceptor 1M as the first image carrier, charging device 2M placed around the photoreceptor 1M, exposure device 3M, developing device 4M, primary transfer roller 5M as a primary transfer device, and cleaning device 6M. Image forming unit 10C forming the cyan image as one toner image of another different color comprises drum-shaped photoreceptor 1C as the first image carrier, charging device 2C placed around the photoreceptor 1C, exposure device 3C, developing device 4C, primary transfer roller 5C as a primary transfer device, and cleaning device 6C. Image forming unit 10K forming the black image as one toner image of another different color comprises drum-shaped photoreceptor 1K as the first image carrier, charging device 2K placed around the photoreceptor 1K, exposure device 3K, developing device 4K, primary transfer roller 5K as a primary transfer device, and cleaning device 6K.

Endless-belt-shaped intermediate transfer member unit 7 is windingly wound with a plurality of rollers, and has endless-belt-shaped intermediate transfer member 70 as an intermediate transfer endless-belt-shaped second image carrier arranged to be supported and capable of rotation.

Color images formed by image forming units 10Y, 10M, 10C, and 10K each are sequentially transferred onto rotating endless-belt-shaped intermediate transfer member 70 by primary transfer rollers 5Y, 5M, 5C, and 5K so that a composite color image is formed. Recording medium P such as a sheet as a recording medium stored in sheet feeding cassette 20 is fed by sheet feeding device 21, conveyed to secondary transfer roller 5A as a secondary transfer device through a plurality of intermediate rollers 22A, 22B, 22C, 22D, and registration roller 23, and then, the color image is secondarily transferred onto recording medium P all at once. Recording medium P on which the color image has been transferred is fixed by heating device 24 in which heat roller fixing unit 24 is installed, sandwiched by paper-ejection roller 25, and mounted on paper-ejection tray 26 outside the machine.

On the other hand, after the color image has been transferred onto recording medium P by secondary transfer roller 5A, residual toner is removed from endless-belt-shaped intermediate transfer member 70, from which recording member P has self-striped, with cleaning device GA.

During image forming processing, primary transfer roller 5K is constantly pressed against photoreceptor 1K. Other primary transfer rollers 5Y, 5M, and 5C are pressed against photoreceptors 1Y, 1M, and 1C, respectively only during color image formation.

Secondary transfer roller 5A is pressed against endless-belt-shaped intermediate transfer member 70 only when recording medium P passes through here and the secondary transfer is carried out.

Enclosure 8 is capable of being drawn out of apparatus main body A guided by supporting rails 82L and 82R.

Enclosure 8 comprises image forming units 10Y, 10M, 10C and 10K, and endless-belt-shaped intermediate transfer member unit 7.

Image forming units 10Y, 10M, 10C, and 10K are disposed vertically in alignment. Endless-belt-shaped intermediate transfer member unit 7 is disposed on the left side, in the figure, of photoreceptors 1Y, 1M, 1C, and 1K. Endless-belt-shaped intermediate transfer member unit 7 comprises endless-belt-shaped intermediate transfer member capable of rotation 70 by winding rollers 71, 72, 73, 74 and 76, primary transfer rollers 5Y, 5M, 5C and 5K, and cleaning device 6A.

Image forming units 10Y, 10M, 10C, and 10K, and endless-belt-shaped intermediate transfer member unit 7 are pulled out of main body A in an integrated manner via pulling-out operation of enclosure 8.

In this way, toner images are formed on photoreceptors 1Y, 1M, 1C and 1K via electrification, exposure and development, toner images of each color are superimposed on endless-belt-shaped intermediate transfer member 70 to be transferred into transfer medium P all at once, and to be subsequently fixed via applied pressure and heating by belt system fixing device 24. As to photoreceptors 1Y, 1M, 1C and 1K after transferring toner images into recording member P, toner remaining on the photoreceptors is cleaned during transfer employing cleaning device 6A, and a cycle of the above-described electrification, exposure and development is subsequently carried out to conduct the next image formation.

An elastic blade is used in the above-described color image forming apparatus as a cleaning member for cleaning device 6A to clean the intermediate transfer member.

Further, devices 11Y, 11M, 11*c* and 11K to coat a fatty acid metal salt are provided for each photoreceptor.

In addition, the same fatty acid metal salt as used for toner is usable.

EXAMPLE

Next, the present invention is described in detail referring to examples, but embodiments of the present invention are not limited thereto.

<<Preparation of Washing Water>>

The following washing water is first prepared.

<Preparation of Washing Water 1, Washing Water 2, Washing Water 3 and Washing Water 4>>

After well water was filtrated with a filter having a mesh of 0.1 μm to remove undissolved substances, deionized water was prepared with an ion-exchange device.

In addition, the resulting total dissolution component amount of the deionized water was 0.02 mg/liter.

Sodium chloride (Wako special grade: produced by Wako Pure Chemical Industries, Ltd.) was added and dissolved in this deionized water to prepare washing water 1, washing water 2, washing water 3 and washing water 4 each having a different total dissolution component amount at 25° C. as described below.

Washing water 1: The total dissolution component amount is 0.25 mg/liter.

Washing water 2: The total dissolution component amount is 0.06 mg/liter.

Washing water 3: The total dissolution component amount is 0.45 mg/liter.

Washing water 4: The total dissolution component amount is 0.60 mg/liter.

<Preparation of Washing Water 5>

Washing water 5 having a total dissolution component amount of 0.25 mg/liter was prepared similarly to preparation of washing water 1, except that sodium chloride employed in the preparation of washing water 1 was replaced by calcium hydrogen carbonate (Wako special grade: produced by Wako Pure Chemical Industries, Ltd.).

<Preparation of Washing Water 5>

Water staying prepared with an ion-exchange device (having a total dissolution component amount of 0.02 mg/liter) is designated as washing water 6.

<Preparation of Washing Water 7, Washing Water 8, Washing Water 9 and Washing Water 10>

Washing water 7, washing water 8, washing water 9 and washing water 10 were prepared similarly to preparation of washing water 1, except that sodium chloride employed in the preparation of washing water 1 was replaced by glucose (produced by Wako Pure Chemical Industries, Ltd.), and the total dissolution component amounts were adjusted to 0.06 mg/liter, 0.25 mg/liter, 0.45 mg/liter and 0.60 mg/liter, respectively.

<Preparation of Washing Water 11, Washing Water 12, Washing Water 13 and Washing Water 14>

Washing water 11, washing water 12, washing water 13 and washing water 14 were prepared similarly to preparation of washing water 1, except that sodium chloride employed in the preparation of washing water 1 was replaced by sodium dodecyl sulfate (Wako special grade: produced by Wako Pure Chemical Industries, Ltd.), and the total dissolution component amounts were adjusted to 0.06 mg/liter, 0.25 mg/liter, 0.45 mg/liter and 0.60 mg/liter, respectively.

<Preparation of Washing Water 15, Washing Water 16, Washing Water 17 and Washing Water 18>

Washing water 15, washing water 16, washing water 17 and washing water 18 were prepared similarly to preparation of washing water 1, except that sodium chloride employed in the preparation of washing water 1 was replaced by an ascorbic acid (produced by Wako Pure Chemical Industries, Ltd.), and the total dissolution component amounts were adjusted to 0.06 mg/liter, 0.25 mg/liter, 0.45 mg/liter and 0.60 mg/liter, respectively.

<<Preparation of Toner>>

A dispersion of toner mother particles was prepared in an aqueous medium, and toner mother particles are filtrated from the dispersion of toner mother particles to form a toner cake. This toner cake was washed with washing water, followed by drying to prepare a toner via addition of external additives.

<Preparation of Toner Mother Particle Dispersion>

{Preparation of Toner Mother Particle Dispersion 1 (an Example of Emulsion Association Method)}

[Preparation of Latex (1HML)]

As described below, the first stage polymerization, the second stage polymerization, and subsequently, the third stage polymerization were conducted to prepare "latex (1HML)" having a multilayer structure.

(1) Preparation of Core Particle (the First Stage Polymerization)

A surfactant solution (aqueous medium) in which 7.08 parts by weight of an anionic surfactant represented by the following formula, $C_{10}H_{21}(OCH_2CH_2)_2OSO_3Na$, were dissolved in 3010 parts by weight of deionized water was charged into a separable flask equipped with a stirring device, a thermometer sensor, a cooling tube and a nitrogen-introducing device, and temperature of the inside of the flask was raised to 80° C. while stirring at a stirring speed of 230 rpm under nitrogen flow.

An initiator solution in which 9.2 parts by weight of a polymerization initiator (potassium persulfate: KPS) were dissolved in 200 parts by weight of deionized water was added into this surfactant solution, and heated to 75° C. Then, a monomer mixture solution containing 70.1 parts by weight of styrene, 19.9 parts by weight of n-butyl acrylate, and 10.9 parts by weight of a methacrylic acid was dropped spending one hour, and this system was heated while stirring at 75° C. for 2 hours to conduct polymerization (the first stage polymerization), and to prepare latex (a resin particle dispersion formed from a high molecular weight resin). This latex is designated as "latex (1H)".

(2) Formation of Intermediate Layer (the Second Stage Polymerization)

In a flask fitted with a stirrer, 98.0 parts by weight of a compound represented by the following formula (hereinafter, referred to as "Exemplified Compound") as wax were added into a monomer mixture solution containing 105.6 parts by weight of styrene, 30.0 parts by weight of n-butyl acrylate, 6.2 parts by weight of a methacrylic acid, and 5.6 parts by weight of n-Octyl-3-mercaptopropionic acid ester, and temperature of the system was raised to 90° C. for dissolution to prepare a monomer solution.

Exemplified Compound: $CH_3(CH_2)_{20}COOCH_2C(CH_2OCO(CH_2)_{20}CH_3)_3$

On the other hand, a surfactant solution prepared by dissolving 1.6 parts by weight of an anionic surfactant {the formula described above} in 270 ml of deionized water was heated to 98° C., and 28 parts by weight of the foregoing "latex (1H)" in terms of solid content as a core particle dispersion were added into this surfactant solution. Subsequently, the monomer solution of the foregoing exemplified compound was mixed and dispersed spending 8 hours with a mechanical homogenizer fitted with a circulation path "CLEARMIX, manufactured by M Technique Co." to prepare a dispersion (emulsified liquid) containing emulsified particles (oil droplets) having a dispersion particle diameter of 284 nm.

Subsequently, an initiator solution in which 5.1 parts by weight of a polymerization initiator (KPS) were dissolved in 200 ml of deionized water, and 750 ml of deionized water were added into this dispersion (emulsified liquid), and this system was heated while stirring at 98° C. for 12 hours to conduct polymerization (the second stage polymerization), and to obtain latex (a dispersion formed from composite resin particles each having a structure in which the surface of a resin particle made of a high molecular weight resin is covered with a medium molecular weight resin. This latex is designated as "latex (1HM)".

When the forgoing "latex (1HM)" is dried for scanning microscopic observation, observed were particles each made of exemplified compound (19) as a principal component which has not been surrounded by latex (400-1000 nm in particle size).

(3) Formation of Outer Layer (the Third Stage Polymerization)

An initiator solution in which 7.4 parts by weight of a polymerization initiator (KPS) were dissolved in 200 parts by weight of deionized water was added into "latex (1NM)" obtained as described above, and a monomer mixture solution containing 300 parts by weight of styrene, 95 parts by weight of n-butyl acrylate, and 15.3 parts by weight of a methacrylic acid, and 10.4 parts by weight of n-octyl-3-mercaptopropionic acid ester was dropped spending one hour at 80° C. After completion of dropping, this system was heated while stirring at for 2 hours to conduct polymerization (the third stage polymerization). Subsequently, the system was cooled down to 28° C. to obtain latex (a dispersion formed from composite resin particles each not only composed of a core made of a high molecular weight resin, an intermediate layer made of a medium molecular weight resin and an outer layer made of a low molecular weight resin, but also containing exemplified compound (19) in an intermediate layer. This latex is designated as "latex (1HML)".

Composite resin particles formed from this "latex (1HML)" have a peak molecular weight (weight) of 138000, 80000 or 13000, and the composite resin particles have a weight average particle diameter of 122 nm.

[Preparation of Toner Mother Particle Dispersion]

In 1600 ml of deionized water, 59.0 parts by weight of an anionic surfactant (sodium dodecyl sulfate) were dissolved while stirring, and 420.0 parts by weight of carbon black (Mogal L; produced by Cabot Corp.) were gradually added into the resulting solution while stirring, followed by a dispersing treatment employing "CLEARMIX" manufactured by M Technique Co., Ltd.)" to prepare "colorant particle dispersion".

In a reaction vessel (four-neck flask) equipped with a stirring device, a thermometer sensor, a cooling tube and a nitrogen-introducing device, 420.7 parts by weight of "latex (1HML)", 900 parts by weight of deionized water and 166 parts by weight of "colorant particle dispersion" were charged while stirring. After adjusting temperature of the vessel to 30° C., 5 mol/liter of sodium hydroxide were added into the resulting solution to adjust pH to 8.

Next, an aqueous solution in which 12.1 parts by weight of magnesium chloride hexahydrate were dissolved in 1000 ml of deionized water was added at 30° C. for 10 minutes while stirring. After standing for 3 minutes, temperature starts increasing, and the temperature of this system was raised to 90° C. spending 6-60 minutes to produce associated particles via coagulation of "latex (1HML)" with "colorant particles". In such the state, the particle diameter of the associated particles was measured employing "Multisizer 3" (manufactured by Coulter Co.), and when a volume-based median particle diameter $D_{50}$ reached 6.4 μm, the particle growth was terminated via addition of an aqueous solution prepared by dissolving 80.4 parts by weight of sodium chloride in 1000 ml of deionized water. Then, a ripening treatment was further carried out at a liquid temperature of 98° C. for 2 hours by heating while stirring to complete fusion of particles.

Subsequently, the resulting was cooled down to 30° C., and adjusted to a pH of 4.5 via addition of a hydrochloric acid to prepare "toner mother particle dispersion 1" in which the toner mother particles having a volume-based median particle diameter $D_{50}$ of 6.5 μm were dispersed.

{Preparation of Toner Mother Particle Dispersion 2 (Example of an Emulsion Association Method)}

[Preparation of Resin Particle Dispersion]

A solution in which 370 parts by weight of styrene, 30 parts by weight of n-butyl acrylate, 8 parts by weight of an acrylic acid, 24 parts by weight of dodecanethiol, and 4 parts by weight of carbon tetrabromide was emulsion-polymerized in a flask in which 6 parts by weight of a nonionic surfactant "nonylphenyl ether", and 10 parts by weight of an anionic surfactant "sodium dodecylbenzenesulfonate" were dissolved in 550 parts by weight of deionized water. After this, a solution prepared by dissolving 4 parts by weight of ammonium persulfate in 50 parts by weight of deionized water was charged in the above-described resulting solution while slowly stirring for 10 minutes. After replacing air by nitrogen, the content in the flask was heated up to 70° C. with an oil bath while stirring the inside of the flask, and the emulsion polymerization was continuously carried out for 5 hours without changing the present condition. As the result, "resin particle dispersion 2", in which resin particles having a volume average particle diameter of 150 nm, a glass transition temperature of 58° C. and a weight average molecular weight of 11,500 were dispersed, were prepared, and The solid content of this dispersion was 40% by weight.

[Preparation of Colorant Dispersion]

| | |
|---|---|
| Colorant "Mogal L" | 60 parts by weight |
| Nonionic surfactant "nonylphenyl ether" | 5 parts by weight |
| Deionized water | 240 parts by weight |

The above-described components were mixed and dissolved, and subsequently stirred with a homogenizer Ultratalax T50, manufactured by IKA Co., Ltd. Thereafter, the solution was subjected to a dispersing treatment employing a mechanical homogenizer to prepare "colorant dispersion 2" in which colorant particles having a volume average diameter of 250 nm were dispersed.

(Preparation of Wax Dispersion)

| | |
|---|---|
| Paraffin wax (melting point: 97° C.) | 100 parts by weight |
| Cationic surfactant "alkylammonium salt" | 5 parts by weight |
| Deionized water | 240 parts by weight |

The above-described components were mixed and dispersed in a round flask made of stainless steel for 10 minutes employing a homogenizer "Ultratalax T50" manufactured by IKA Co., Ltd. Thereafter, the solution was subjected to a dispersing treatment employing a pressure jetting type homogenizer to prepare "wax dispersion 2" in which wax particles having a volume average diameter of 550 nm were dispersed.

(Preparation of Coagulated Particle)

| | |
|---|---|
| Resin particle dispersion 2 | 234 parts by weight |
| Colorant dispersion 2 | 30 parts by weight |
| Wax dispersion 2 | 40 parts by weight |
| Polyaluminum chloride | 1.8 parts by weight |
| Deionized water | 600 parts by weight |

After the above-described components were mixed and dispersed in a round flask made of stainless steel employing a homogenizer "Ultratalax T50" manufactured by IKA Co., Ltd., the solution was heated up to 55° C. in an oil bath while stirring the inside of the flask. After standing at 55° C. for 30 minutes, it was confirmed that coagulated particles having a median particle diameter D50 of 4.8 μm were formed in the solution. Further, when holding at 56° C. for 2 hours after raising the temperature of the oil bath, the median particle diameter D50 reached 5.9 μm. After this, 32 parts by weight of "resin particle dispersion 2" was added into a dispersion containing the above-described coagulated particles, and then the temperature of the oil bath was raised up to 55° C. and was maintained for 30 minutes to prepare coagulated particles. Into a dispersion containing the "coagulated particle 2", 1 mole/liter of sodium hydroxide was added to adjust a pH of the system to 5.0, and then the flask made of stainless steel was sealed by magnetic sealing, and the system was heated to 95° C. while continuously stirring, standing for 6 hours to prepare "toner mother particle dispersion 2" in which the toner mother particles having a volume-based median particle diameter $D_{50}$ of 6.0 were dispersed.

{Preparation of Toner Mother Particle 3 (Example of Polyester Association Method)}

[Preparation of Polyester Resin]

Into a polycondensation reaction vessel, charged were 715.0 parts by weight of dimethyl phthalate, 95.8 parts by weight of sodium dimethyl 5-sulfoisophthalate, 526.0 parts by weight of propanediol, 48.0 parts by weight of diethylene glycol, 247.1 parts by weight of dipropylene glycol, and 1.5 parts by weight of a butyl tin hydroxide catalyst. The resulting mixture was heated to 190° C., and then the temperature was slowly raised to approximately 200-202° C. while collecting an alcohol byproduct in a distillation vessel. After this, the temperature was raised to approximately 210° C. spending about 4.5 hours while reducing the pressure from the atmospheric pressure to about 1067 Pa. Then, the product was taken out. Thus "polyester resin 3" having a glass transition temperature of 53.8° C. was prepared.

[Preparation of Polyester Resin Emulsion]

Into 1,232 parts by weight of deionized water, 168 parts by weight of the above-described "polyester resin 3" were added, and the resulting solution was stirred at 92° C. for 2 hours to prepare "polyester resin emulsion 3".

(Association Process)

In a reaction vessel, 1,400 parts by weight of "polyester resin emulsion 3" and 14.22 parts by weight of "Mogal L" were charged to prepare "emulsion/dispersion 3".

Next, a 5% by weight zinc acetate solution was prepared by dissolving zinc acetate in deionized water. The solution was charged in a receptacle placed on a weighing scale, and connected to a pump capable of exactly supplying the zinc acetate solution at a rate of 0.01-9.9 ml/minute. The amount of zinc acetate consumed for association of the emulsion is 10% of the weight of the resin in the emulsion.

After "emulsion/dispersion 3" was heated to 56° C., the zinc acetate solution was supplied at a rate of 9.9 ml/minute to start association. When 60% by weight of the total amount of zinc acetate (205 parts by weight of a 5% by weight solution) were added, a pump-addition rate of the solution was reduced to 1.1 ml/minute, and the zinc acetate solution was continuously added until the zinc acetate amount reached 10% by weight of the resin in the emulsion (335 parts by weight of a 5% by weight solution). The system was stirred at 80° C. for 9 hours to prepare to prepare "toner mother particle dispersion 3" in which the toner mother particles having a volume-based median particle diameter $D_{50}$ of 5.9 μm were dispersed.

{Preparation of Toner Mother Particle Dispersion 4 (Example of Suspension Polymerization Method)}

A solution in which 165 parts by weight of styrene, 35 parts by weight of n-butyl acrylate, 10 parts by weight of "Mogal L", 2 parts by weight of a di-t-butyl salicylate metal compound, 8 parts by weight of styrene-methacrylic acid copolymer and 20 parts by weight of paraffin wax (mp=70° C.) was heated to 60° C., and uniformly dissolved and dispersed at 12,000 rpm employing "TK Homomixer2, manufactured by Tokushu Kika Kogyo Co., Ltd. Into this solution, 10 parts by weight of 2,2'-azobis(2,4-valeronitrile) were added as a polymerization initiator to prepare "polymerizable monomer composition 4". After this, 450 parts by weight of a 0.1 M sodium phosphate solution was added into 710 parts by weight of deionized water, and 68 parts by weight of a 1.0 M calcium chloride solution was gradually added while stirring at 13,000 rpm employing "TK Homomixer" to prepare "suspension 4" in which calcium triphosphate was dispersed. The above-described "polymerizable monomer composition 4" was added into "suspension 4", and the system was stirred at 10,000 rpm for 20 minutes employing "TK Homomixer" to granulate "polymerizable monomer composition 4". After this, reaction was conducted at 75-95° C. for 5-15 hours by using a reaction apparatus. Calcium triphosphate was dissolved with a hydrochloric acid, and removed to prepare "toner mother particle dispersion 4" in which the toner mother particles having a volume-based median particle diameter $D_{50}$ of 5.9 μm were dispersed.

{Preparation of Toner Mother Particle Dispersion 5 (Example of Dissolving Suspension Method)}

[Preparation of Pigment Dispersion]

| | |
|---|---|
| Polyester resin having a Tg of 60° C., a softening point of 98° C., and a weight average molecular weight of 9,500 | 50 parts by weight |
| Mogal L | 50 parts by weight |
| Ethyl acetate | 100 parts by weight |

A dispersion of the above-described components was charged in a vessel in which glass beads were provided, which was installed in a sand mill homogenizer. Dispersing was carried out in the high speed stirring mode for 8 hours while cooling around the vessel. After this, the resulting dispersion was diluted with ethyl acetate to prepare "pigment dispersion 5" having a pigment concentration of 15% by weight.

(Preparation of Microparticulated Wax Dispersion)

| | |
|---|---|
| Paraffin wax (melting point: 85° C.) | 15 parts by weight |
| Toluene | 85 parts by weight |

The above-described components were charged in a dispersing machine equipped with stirring wings, having a function of circulating a thermal medium around the vessel. The temperature of the mixture was gradually raised and stirred for 3 hours, keeping at 100° C. while stirring at 83 rpm. Next, the resulting solution was cooled down to room temperature at a rate of 2° C. per minute to precipitate microparticulated wax. This wax dispersion was dispersed again at a pressure of $550\times10^5$ Pa employing a high pressure emulsifying machine "APV Gaulin Homogenizer", manufactured by APV Gaulin Co., Ltd. The size of the wax measured at the same time was 0.69 μm. The resulting of microparticulated wax dispersion was diluted with ethyl acetate so as to have a wax content of 15% by weight to prepare "microparticulated wax 5".

[Preparation of Oil Phase]

| | |
|---|---|
| Polyester resin having a Tg of 60° C., a softening point of 98° C., and a weight average molecular weight of 9,500 | 85 parts by weight |
| Pigment dispersion 5 (Pigment content: 15% by weight) | 50 parts by weight |
| Microparticulated wax dispersion 5 (wax content: 15% by weight) | 33 parts by weight |
| Ethyl acetate | 32 parts by weight |

After confirming that the polyester resin in the above-described composition was sufficiently dissolved, the resulting solution was charged in a homomixer "ACE HOMOGENIZER", manufactured by Nihon Seiki Co., Ltd., and stirred at 16,000 rpm for 2 minutes to prepare uniform "oil phase 5".

(Preparation of Water Phase)

| | |
|---|---|
| Calcium carbonate having an average particle diameter of 0.03 μm | 60 parts by weight |
| Deionized water | 40 parts by weight |

The above components were stirred for 4 days employing a ball mill, and the resulting aqueous calcium carbonate solution was designated as "water phase (aqueous calcium carbonate solution) 5". The average particle diameter of the calcium carbonate measured by a laser diffraction/scattering particle size distribution measuring apparatus A-700, manufactured by Horiba Seisakysho Co., Ltd., was approximately 0.08 μm.

| | |
|---|---|
| Carboxymethyl cellulose | 2 parts by weight |
| Deionized water | 98 parts by weight |

The above components were stirred with a ball mill, and the resulting aqueous carboxymethyl cellulose solution was designated as "water phase (aqueous carboxymethyl cellulose solution) 5".

(Preparation of Spherical Particle)

| | |
|---|---|
| Oil phase 5 | 55 parts by weight |
| Water phase (aqueous calcium carbonate solution) 5 | 15 parts by weight |
| Water phase (aqueous carboxymethyl cellulose solution) 5 | 30 parts by weight |

The above components were charged in "COLLOID MILL", manufactured by Nihon Seiki Co., Ltd., and emulsified at a gap spacing of 1.5 mm and at a rotating speed of 9,400 rpm for 40 minutes. Next, the above-described emulsion was charged in a rotary evaporator, and the solvent was removed spending 3 hours under a reduced pressure of 4,000 Pa at room temperature.

Thereafter, a 12 mole/liter solution of hydrochloric acid was added so as to reach a pH of 2 for removing calcium carbonate from the toner surface. After this, a 10 mol/liter solution of sodium hydroxide was added so as to reach a pH of 10 and further, the resulting solution was continuously stirred for one hour in an ultrasonic washing tank to prepare "toner mother particle dispersion 5" in which the toner mother particles having a volume-based median particle diameter $D_{50}$ of 6.0 μm were dispersed.

<Preparation of Toner Mother Particle Dispersion 6 (Example of Continuous Emulsifying Dispersion Method)>

[Synthesis of Polyether Resin (A)]

In a high pressure reaction vessel equipped with a stirring device, a nitrogen introducing pipe, a thermometer and an input opening for raw material, 0.5 parts by weight of potassium hydroxide and 200 parts by weight of toluene as a solvent were charged, and a mixture of 10.8 parts by weight of propylene oxide and 89.2 parts by weight of styrene oxide were gradually injected while stirring and maintaining the pressure and the temperature inside the system at $10\times10^5$ Pa and 40° C. The variation of the molecular weight was traced by a terminal titration method and the reaction was stopped at a time when the number average molecular weight reached 7,000. In this case, the injected amount of propylene oxide was 8.46 parts by weight and that of styrene oxide was 71.4 parts by weight. Toluene and unreacted monomer were removed from the resulting polymer solution at a reduced pressure of 4,000 Pa to obtain "polyether resin (A)".

[Synthesis of Polyester Resin (B) Having No Ether Bond]

In a 5 liter interior volume flask equipped with a stirring device, a nitrogen introducing pipe, a thermometer and a rectifier, 67.85 parts by weight of terephthalic acid, 3.34 parts by weight of neopentyl glycol, 25.58 parts by weight of propylene glycol, 3.22 parts by weight of trimethylolpropane and 0.3 parts by weight of dibutyl tin oxide were charged and reacted by stirring under a nitrogen stream at 240° C. The reaction was stopped when the softening point measured by a ring and ball method reached 130° C. Thus "polyester resin (B)" was obtained. The resulting "polyester resin (B)" was a faint yellow solid, and the weight average molecular weight in terms of polystyrene conversion, which was measured by a GPC measuring method, was 96,000.

A colored resin melt heated to 180° C. was prepared by kneading 18 parts by weight of "polyether resin (A)", 72 parts by weight of "polyester resin (B)" and 10 parts by weight of "Mogal L" employing a double axis continuous kneading machine, and transferred into a rotation type continuous dispersing apparatus "CABITRON CD 1010" (manufactured by Eurotech Co., Ltd.) at a rate of 100 parts by weight per minute. Besides, diluted ammonia water having a content of 0.37% by weight prepared by diluting reagent grade ammonia water with deionized water was stocked in an aqueous medium tank separately arranged to be set. The diluted ammonia water with the colored resin melt was simultaneously transferred into the CABITORON at a rate of 0.1 liter per minute while heating to 150° C. with a heat exchanger. And a 160° C. dispersion in which colored resin spherical particles were dispersed at a rotator rotation rate of 7.500 rpm and a pressure of $5\times10^5$ Pa was obtained, and cooled down to 40° C. to prepare "toner mother particle dispersion 6" in which the toner mother particles having a volume-based median particle diameter $D_{50}$ of 5.9 μm were dispersed.

<Preparation of Toner 1>

(Formation of Toner Cake 1)

The above-prepared "toner mother particle dispersion 1" was subjected to solid-liquid separation employing a rotating cylinder type washing machine "MARK III type number 60X40, manufactured by Matsumoto Kikai Co., Ltd. to form "toner cake 1".

Washing of toner cake 1 was conducted by spraying "washing water 1" heated to 35° C., which has 10 times the toner mother particle weight from a spray nozzle installed in the rotating cylinder type washing machine. In addition, the temperature of washing water was set to 35±2° C.

(Drying of Toner Cake 1)

Next, the toner cake was raked out from the washing machine by a scraper inserted in the washing machine and stored in a vessel. After this, the toner cake was supplied little by little into "FLASH JET DRYER", manufactured by Seishin Kigyo Co., Ltd., and dried until the moisture content of toner mother particles reached 0.5% by weight to prepare "toner mother particle 1".

(Mixing of External Additive)

To 100 parts by weight of "toner mother particle 1" prepared as described above, 0.8 parts by weight of rutile type titanium dioxide (a volume average particle diameter of 20 nm; and an n-decyltrimethoxysilane treatment carried out) and 1.8 parts by weight of spherical monodispersed silica {particles prepared via drying and a pulverizing treatment (particle diameter $D_{50}$ of 127 nm) after silica sol obtained via a sol-gel method was subjected to an HMDS treatment} were mixed and blended at a peripheral speed of 30 m/s for 15 minutes employing "Henschel Mixer", manufactured by Mitsui Miike Kako Co., Ltd. Then the mixture was sieved by a filter having an opening of 45 μm for removing coarse particles to prepare "toner 1".

<Preparation of Toners 2-6>

"Toner 2", "toner 3", "toner 4", "toner 5" and "toner 6" were prepared similarly to preparation of "toner 1", except that washing water 1 employed in the preparation of "toner 1" was replaced by each of washing water 2, washing water 3, washing water 4, washing water 5 and washing water 6, and the amount of washing water was replaced by each of 30 times the toner mother particle weight, 5 times the toner mother particle weight, 5 times the toner mother particle weight, 10 times the toner mother particle weight and 30 times the toner mother particle weight.

<Preparation of Toners 7-11>

"Toner 7", "toner 8", "toner 9", "toner 10" and "toner 11" were prepared similarly to preparation of "toner 1", except that "toner mother particle 1" employed in the preparation of "toner 1" was replaced by each of "toner mother particle 2", "toner mother particle 3", "toner mother particle 4", "toner mother particle 5" and "toner mother particle 6".

<Preparation of Toners 12-16>

"Toner 12", "toner 13", "toner 14, "toner 15" and "toner 16" were prepared similarly to preparation of "toner 7", except that washing water 1 employed in the preparation of "toner 7" was replaced by each of washing water 6, washing water 7, washing water 8, washing water 9 and washing water 10, and the amount of washing water was replaced by 30 times the toner mother particle weight.

<Preparation of Toners 17-21>

"Toner 17", "toner 17", "toner 19, "toner 20" and "toner 21" were prepared similarly to preparation of "toner 8", except that washing water 1 employed in the preparation of "toner 8" was replaced by each of washing water 6, washing water 11, washing water 12, washing water 13 and washing water 14, and the amount of washing water was replaced by 60 times the toner mother particle weight.

<Preparation of Toners 22-26>

"Toner 22", "toner 23", "toner 24, "toner 25" and "toner 26" were prepared similarly to preparation of "toner 9", except that washing water 1 employed in the preparation of "toner 9" was replaced by each of washing water 6, washing water 15, washing water 16, washing water 17 and washing water 18, and the amount of washing water was replaced by 20 times the toner mother particle weight.

<Preparation of Toners 31-50>

Twenty toner lots were prepared under the preparation condition of "toner 1", and these lots were designated in order of preparation as "toner 31", "toner 32", "toner 33", "toner 34", "toner 35", "toner 36", "toner 37", "toner 38", "toner 39", "toner 40", "toner 41", "toner 42", "toner 43", "toner 44", "toner 45", "toner 46", "toner 47", "toner 48", "toner 49" and "toner 50", respectively.

<Preparation of Toners 51-70>

Twenty toner lots were prepared under the preparation condition of "toner 2", and these lots were designated in order of preparation as "toner 51", "toner 52", "toner 53", "toner 54", "toner 55", "toner 56", "toner 57", "toner 58", "toner 59", "toner 60", "toner 61", "toner 62", "toner 63", "toner 64", "toner 65", "toner 66", "toner 67", "toner 68", "toner 69" and "toner 70", respectively.

<Preparation of Toners 71-90>

Twenty toner lots were prepared under the preparation condition of "toner 6", and these lots were designated in order of preparation as "toner 71", "toner 72", "toner 73", "toner 74", "toner 75", "toner 76", "toner 77", "toner 78", "toner 79", "toner 80", "toner 81", "toner 82", "toner 83", "toner 84", "toner 85", "toner 86", "toner 87", "toner 88", "toner 89" and "toner 90", respectively.

The toner mother particle, the washing water, the consumption amount of the washing water (times the toner mother particle weight) are shown in Table 1.

TABLE 1

| | | Washing water | | | |
|---|---|---|---|---|---|
| Toner No. | Toner mother particle No. | Washing water No. | Added water-soluble component | Total dissolution component amount (mg/liter) | *1 |
| Toner 1 | Toner mother particle 1 | Washing water 1 | Sodium chloride | 0.25 | 10 |
| Toner 2 | Toner mother particle 1 | Washing water 2 | Sodium chloride | 0.06 | 30 |
| Toner 3 | Toner mother particle 1 | Washing water 3 | Sodium chloride | 0.45 | 5 |
| Toner 4 | Toner mother particle 1 | Washing water 4 | Sodium chloride | 0.60 | 5 |
| Toner 5 | Toner mother particle 1 | Washing water 5 | Sodium hydrogen carbonate | 0.25 | 10 |
| Toner 6 | Toner mother particle 1 | Washing water 6 | None | 0.02 | 30 |
| Toner 7 | Toner mother particle 2 | Washing water 1 | Sodium chloride | 0.25 | 10 |
| Toner 8 | Toner mother particle 3 | Washing water 1 | Sodium chloride | 0.25 | 10 |
| Toner 9 | Toner mother particle 4 | Washing water 1 | Sodium chloride | 0.25 | 10 |
| Toner 10 | Toner mother particle 5 | Washing water 1 | Sodium chloride | 0.25 | 10 |
| Toner 11 | Toner mother particle 6 | Washing water 1 | Sodium chloride | 0.25 | 10 |
| Toner 12 | Toner mother particle 2 | Washing water 7 | Glucose | 0.06 | 30 |
| Toner 13 | Toner mother particle 2 | Washing water 8 | Glucose | 0.25 | 30 |
| Toner 14 | Toner mother particle 2 | Washing water 9 | Glucose | 0.45 | 30 |
| Toner 15 | Toner mother particle 2 | Washing water 10 | Glucose | 0.60 | 30 |
| Toner 16 | Toner mother particle 2 | Washing water 6 | None | 0.02 | 30 |
| Toner 17 | Toner mother particle 3 | Washing water 11 | Sodium dodecyl sulfate | 0.06 | 60 |
| Toner 18 | Toner mother particle 3 | Washing water 12 | Sodium dodecyl sulfate | 0.25 | 60 |
| Toner 19 | Toner mother particle 3 | Washing water 13 | Sodium dodecyl sulfate | 0.45 | 60 |
| Toner 20 | Toner mother particle 3 | Washing water 14 | Sodium dodecyl sulfate | 0.60 | 60 |
| Toner 21 | Toner mother particle 3 | Washing water 6 | None | 0.02 | 60 |
| Toner 22 | Toner mother particle 4 | Washing water 15 | Ascorbic acid | 0.06 | 20 |
| Toner 23 | Toner mother particle 4 | Washing water 16 | Ascorbic acid | 0.25 | 20 |
| Toner 24 | Toner mother particle 4 | Washing water 17 | Ascorbic acid | 0.45 | 20 |
| Toner 25 | Toner mother particle 4 | Washing water 18 | Ascorbic acid | 0.60 | 20 |
| Toner 26 | Toner mother particle 4 | Washing water 6 | None | 0.02 | 20 |
| Toners 31-50 | Toner mother particle 1 | Washing water 1 | Sodium chloride | 0.25 | 10 |
| Toners 51-70 | Toner mother particle 1 | Washing water 2 | Sodium chloride | 0.03 | 30 |
| Toners 71-90 | Toner mother particle 1 | Washing water 6 | None | 0.02 | 30 |

*1: Consumption amount of washing water (such as 5 times the toner mother particle weight, 10 times the toner mother particle weight, 20 times the toner mother particle weight, 30 times the toner mother particle weight, and 60 times the toner mother particle weight)

<<Preparation of Developer>>

Hundred parts by weight of "ferrite carrier" having a volume average particle diameter of 60 μm and 6 parts by weight of "toner" prepared as described above were mixed for 5 minutes employing a V-shape mixer to prepare developers 1-26, developers 31-50, developers 51-70, and developers 71-90.

<<Evaluation>>

A high-speed image forming apparatus "bizhub C650" (manufactured by Konica Minolta Business Technologies, Inc.) was used as an image forming apparatus for evaluations.

The resulting "toner 1-26", "Toner 31-50", "Toner 51-70" and "Toner 71-90", and "two-component developer 1-26", "two-component developer 31-50", "two-component developer 51-70" and "two-component developer 71-90" were introduced for the evaluations, and 100,000 print sheets of the original image having a printing ratio of 6% (an A4 size image in which a fine line image, a halftone image, a white image and a solid image each are divided into four equal parts) were printed on transfer sheets (64 g/m$^2$) under the printing environment at LL (low temperature and low humidity) of 10° C. and 20% RH. Symbols A and B are set to indicate "pass".

<Fog>

Hundred thousand print sheets were printed at LL (low temperature and low humidity) of 10° C. and 20% RH for evaluation of fog, and reflection density (fog density) of the white area on a printed image prepared at a time when printing of 100000 print sheets was completed was measured at 20 points employing a reflection densitometer "RD-918, manufactured by Macbeth Co." for the evaluation made with a mean value thereof. In addition, a fog of 0.014 or less is set to indicate "pass".

<Image Density>

Hundred thousand print sheets were printed at LL (low temperature and low humidity) of 10° C. and 20% RH for evaluation of image density, and image density of the solid image on a printed image prepared at a time when printing of 100000 print sheets was completed was measured at 20 points employing a reflection densitometer "RD-918, manufactured by Macbeth Co." for the evaluation made with a mean value thereof. In addition, an image density of at least 1.30 is set to indicate "pass".

<Transfer Image Unevenness>

Hundred thousand print sheets were printed at HH (high temperature and high humidity) of 30° C. and 80% RH for evaluation of transfer image unevenness, and image unevenness of the halftone image on a printed image prepared at a time when printing of 100000 print sheets was completed was visually observed.

Evaluation Criterion

A: No transfer image unevenness is visually observed. Excellent (Very clean)

B: Transfer image unevenness is slightly observed, but at no problematic level (appearing slightly granular).

C: Transfer image unevenness is observed by tilting a transfer paper sheet to look at it, but there appears no practical problem.

D: Transfer image unevenness is clearly observed, and there appears a practical problem.

Evaluation results are shown in Table 2.

TABLE 2

| | Toner | Fog at LL | Image density at LL | Transfer image unevenness at HH |
|---|---|---|---|---|
| Example 1 | Toner 1 | 0.004 | 1.40 | A |
| Example 2 | Toner 2 | 0.005 | 1.35 | A |
| Example 3 | Toner 3 | 0.005 | 1.35 | B |
| Example 4 | Toner 5 | 0.004 | 1.40 | A |
| Example 5 | Toner 7 | 0.004 | 1.35 | A |
| Example 6 | Toner 8 | 0.004 | 1.40 | A |
| Example 7 | Toner 9 | 0.004 | 1.40 | A |
| Example 8 | Toner 10 | 0.004 | 1.35 | A |
| Example 9 | Toner 11 | 0.004 | 1.40 | A |
| Example 10 | Toner 12 | 0.005 | 1.35 | A |
| Example 11 | Toner 13 | 0.004 | 1.40 | A |
| Example 12 | Toner 14 | 0.004 | 1.35 | B |
| Example 13 | Toner 17 | 0.006 | 1.40 | A |
| Example 14 | Toner 18 | 0.006 | 1.30 | B |
| Example 15 | Toner 19 | 0.007 | 1.35 | B |
| Example 16 | Toner 22 | 0.004 | 1.40 | A |

TABLE 2-continued

| | Toner | Fog at LL | Image density at LL | Transfer image unevenness at HH |
|---|---|---|---|---|
| Example 17 | Toner 23 | 0.004 | 1.35 | A |
| Example 18 | Toner 24 | 0.005 | 1.40 | B |
| Comparative example 1 | Toner 4 | 0.007 | 1.40 | D |
| Comparative example 2 | Toner 6 | 0.015 | 1.15 | B |
| Comparative example 3 | Toner 15 | 0.006 | 1.40 | D |
| Comparative example 4 | Toner 16 | 0.020 | 1.05 | C |
| Comparative example 5 | Toner 20 | 0.008 | 1.40 | D |
| Comparative example 6 | Toner 21 | 0.015 | 1.15 | B |
| Comparative example 7 | Toner 25 | 0.007 | 1.40 | D |
| Comparative example 8 | Toner 26 | 0.020 | 1.20 | C |

<Variation in Charging Amount Among Toner Manufacturing Lots>

The variation in charging amount among toner manufacturing lots was obtained by measuring the toner charging amount in each lot after installing the toner in order in the image forming apparatus at low temperature and low humidity (10° C. and 20% RH) as a printing environment. The charging amount was measured employing a blow-off type charging amount measuring device "TB-200, manufactured by Toshiba Chemical Corporation". In addition, as to The variation in charging amount among toner manufacturing lots, symbols "A" and "B" are set to indicate "pass".

Evaluation Criterion

A: The variation range of charging amount among 20 toner manufacturing lots is 5 μC/g or less.)

B: The variation range of charging amount among 20 toner manufacturing lots is a range exceeding 5 μC/g, but being not more than 10 μC/g.

C: The variation range of charging amount among 20 toner manufacturing lots is exceeds 10 μC/g or less.

<Variation in Image Density Among Toner Manufacturing Lots>

As to the variation in image density among toner manufacturing lots, the image density of each toner lot was measured after installing the toner in order in the image forming apparatus.

The amount of toner attached on a transfer sheet is adjusted at low temperature and low humidity (10° C. and 20% RH) in such a way that the toner on the transfer sheet is evenly attached, and a solid image of a square, 5 cm on a side is printed to measure image density of the resulting printed image employing a transmission densitometer (TD904, manufactured by Macbeth Co.). In addition, as to image density, symbols "A" and "B" are set to indicate "pass".

Evaluation Criterion

A: All of 20 toner manufacturing lots, having an image density of at least 1.30

B: Eighteen out of 20 toner manufacturing lots, having an image density of at least 1.30

C: At least 3 out of 20 toner manufacturing lots, having an image density of 1.30 or less The evaluation results are shown in Table 3.

TABLE 3

| | Toner | Variation in charging amount among toner manufacturing lots | Image density |
|---|---|---|---|
| Example 19 | Toners 31-50 | A | A |
| Example 20 | Toners 51-70 | B | B |
| Comparative example 9 | Toners 71-90 | C | C |

As shown in Table 2 and Table 3, Examples 1-20 of the present invention exhibited excellent results in any of the evaluation items. In contrast, it was confirmed that Comparative examples 1-9 outside the present invention appeared problematic in any of the evaluation items, whereby no effect of the present invention was produced.

EFFECT OF THE INVENTION

A method of manufacturing an electrostatic charge image developing toner in the present invention produces an excellent effect in which no fog is generated; high density print images are acquired; and variation in charging amount among manufacturing lots is minimized, even though printing a large number of print sheets at low temperature and low humidity (for example, at 10° C. and 20% RH).

What is claimed is:

1. A method of manufacturing an electrostatic charge image developing toner, comprising the step of:

washing toner mother particles having been formed in an aqueous medium with washing water, wherein the washing water has a total dissolution component amount of at least 0.05 mg/liter and less than 0.5 mg/liter.

2. The method of claim 1, comprising the step of:

coagulating/fusing resin particles and colorant particles in the aqueous medium to obtain the toner mother particles.

3. The method of claim 2, comprising the steps of:

forming a toner mother particle dispersion via the step of coagulating/fusing the resin particles and the colorant particles in the aqueous medium, solid-liquid-separating the toner mother particles after cooling the toner mother particle dispersion, washing the toner mother particles having been solid-liquid-separated with the washing water, and drying the toner mother particles having been washed.

4. The method of claim 1, wherein the washing water has a temperature of 25-45° C.

5. The method of claim 1, wherein the total dissolution component in the washing water comprises at least one of a salt obtained via combination of a cation and an anion, a nonionic compound and an organic compound, provided that the cation is one selected from the group consisting of $Ca^{2+}$, $Mg^{2+}$, $Na^{2+}$, $Fe^{2+}$ and $Mn^{2+}$, the anion is one selected from the group consisting of $HCO_3^-$, $Cl^-$, $SO_4^{2-}$ and $NO_3^-$, the nonionic compound is polyoxyethylenealkyl ether, and the organic compound is one compound selected from the group consisting of saccharides and water-soluble vitamins.

6. The method of claim 1, wherein the total dissolution component in the washing water comprises sodium chloride, glucose, sodium dodecyl sulfate or an ascorbic acid.

7. The method of claim 1, wherein weight of the washing water is 1-70 times weight of the toner mother particles.

8. The method of claim 7, wherein the weight of the washing water is 5-30 times the weight of the toner mother particles.

* * * * *